United States Patent [19]

Köbler

[11] Patent Number: 4,930,383

[45] Date of Patent: Jun. 5, 1990

[54] COMBINATION CUTTING AND PATH SWITCHING APPARATUS FOR MOVING WEBS, PARTICULARLY PRINTED PAPER SUBSTRATES, AND METHOD

[75] Inventor: Ingo Köbler, Anhausen, Fed. Rep. of Germany

[73] Assignee: MAN ROLAND Druckmaschinen AG, Offenbach am Main, Fed. Rep. of Germany

[21] Appl. No.: 207,146

[22] Filed: Jun. 15, 1988

[30] Foreign Application Priority Data

Jun. 30, 1987 [DE] Fed. Rep. of Germany ..... 3721516

[51] Int. Cl.[5] ..... B26D 7/32; B65H 29/60

[52] U.S. Cl. ..... 83/27; 83/37; 83/106; 83/107; 83/155; 83/337; 83/346

[58] Field of Search ..... 83/27, 37, 102, 105, 83/106, 107, 150, 155, 156, 161, 337, 346; 271/302-304, 314

[56] References Cited

U.S. PATENT DOCUMENTS

| | | | |
|---|---|---|---|
| 2,076,969 | 4/1937 | Sieger | 83/322 |
| 2,414,772 | 1/1947 | Sheperdson | 83/106 |
| 4,189,965 | 2/1980 | Kollann | 83/155 |
| 4,729,282 | 3/1988 | Kasdorf | 83/26 |
| 4,811,641 | 3/1989 | Müller | 83/346 |

FOREIGN PATENT DOCUMENTS

| | | | |
|---|---|---|---|
| 1236 | 1/1936 | Australia | 83/346 |

*Primary Examiner*—Hien H. Phan

*Attorney, Agent, or Firm*—Frishauf, Holtz, Goodman & Woodward

[57] ABSTRACT

To deflect a moving paper web to respective transport paths (16, 17, 21, 25) by a cutter cylinder - counter cylinder combination (7, 8), the cylinders are oscillated back and forth above the respective transport paths by being retained in journal bearings which are eccentric with respect to the axes of rotation of the cylinders, so that, as the cylinders rotate, the nip between the cylinders will be in alignment with the respective transport path, the shift directing the leading edge of the web to a respective transport path. The cylinders, each, carry a knife and a counter element diametrically located with respect to each other, so that, as the leading edge of the web is gripped between a respective transport path, the web is severed thereafter and as the cylinder moves into alignment with the other transport path to feed the leading edge of the web to the other transport path for subsequent cutting, and so on.

11 Claims, 2 Drawing Sheets

COMBINATION CUTTING AND PATH SWITCHING APPARATUS FOR MOVING WEBS, PARTICULARLY PRINTED PAPER SUBSTRATES, AND METHOD

Reference to related application, assigned to the assignee of the present invention, the disclosure of which is hereby incorporated by reference:

U.S. Ser. No. 07/207,145, filed June 15, 1988, KOBLER now U.S. Pat. No. 4,893,534

Reference to related patent: U.S. Pat. No. 4,373,713.

The present invention generally relates to paper handling apparatus, and more particularly cutting a continuously supplied web of paper and then distributing the cut sheets into two different paths for removal.

BACKGROUND

It has previously been proposed, see U.S. Pat. No. 4,373,713, to subdivide cut sheets which are cut from a continuous substrate web. The substrate web is supplied to a rotating cylinder pair by continuously operating transport means, such as transport belts. Deflection tongues are located behind the cylinder pair. Each cylinder of the cylinder pair has a segment which projects out of the circumferential surface of the cylinder into the selected transport path for the printed substrate. The circumferential position of the segments, and the speed of the cylinder pairs, with respect to the speed and position of the received web, are so synchronized or related to each other that the segment of one cylinder guides the substrate beneath a fixed deflection tongue and then into a first transport path, while the segment of the other cylinder guides the substrate over the deflection into a second transport path.

The sheets which are supplied are already severed from a web, so that an additional cutter element must be provided in order to cut the sheets from a continuous substrate. This increases the size of the apparatus.

THE INVENTION

It is an object to provide a combination cutter and path switching or selection apparatus, which is compact and permits severing a continuous web into cut sheets and, additionally, carrying out the distribution or switching function to switch the then cut sheets into respectively different transport paths.

Briefly, a pair of cylinders, forming cutter and counter cylinders, have a substrate web supplied thereto. Two removal transport paths are located, symmetrically with respect to the axes of the cylinder pair. To direct the paper web into the respective path, the rotating cylinders of the pair are eccentrically journalled. Eccentric movement of the cylinders is synchronized with respect to each other and the speed of paper supply so that the cylinders will oscillate between positions in which the nip between the cylinders shifts with respect to the removal transport paths to direct the paper web into the respective transport path. Once the paper is directed in the respective transport path and gripped therein, and upon further rotation of the cylinders, the paper is cut. Thus, the leading edge of the paper web, from which in a previous operating cycle a sheet had been severed, is directed to the respective removal path; then, with the leading edge in the removal path, the trailing edge of what will be the cut sheet is severed from the web to form a leading web edge which, upon oscillation of the cylinders, is then directed into an adjacent transport path.

Drawings, illustrating an embodiment:

FIG. 1 is a highly schematic side view of the combination cutting and path switching apparatus in a first operating position; and FIG. 2 shows the apparatus of FIG. 1 in a second operating position.

DETAILED DESCRIPTION

A substrate web 2, typically a printed paper web, is to the apparatus 1, preferably, but not necessarily, in vertical direction. Two pairs of pulling rollers 3, 4 and 5, 6 guide and transport the paper web 2.

Figure 1:
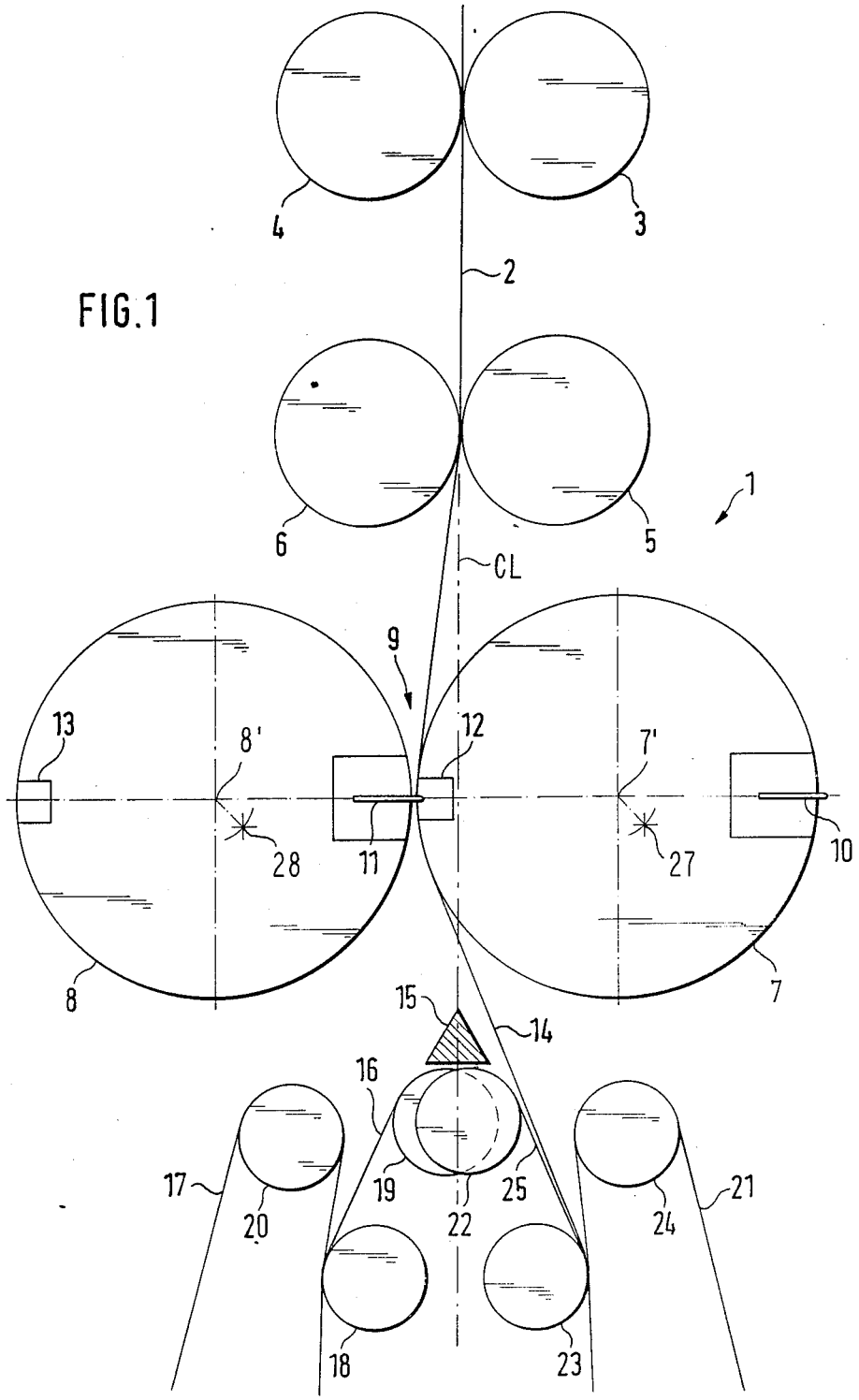

The apparatus includes two cylinders, forming a cutter cylinder-counter cylinder pair, in which the respective cylinders 7, 8 each have a cutting knife 10, 11 and a counter element 12, 13 thereon, offset diametrically with respect to each other, and so arranged that when knife 11 of cylinder 8 is in a position of the nip between the cylinders 7, 8, it will be opposite the counter element 12 on cylinder 7-see FIG. 1-and, after rotation of the cylinders about 180°, the knife 10 will be opposite counter element 13. The knives are projectable from the contour of the respective cylinders 7, 8, as well known, for example controlled by cams or the like.

In accordance with the invention, the cylinders 7, 8 are retained in eccentric journals, so that the cylinders not only rotate about their own axes of rotation but, in addition, shift the center of rotation. Consequently, and upon rotation of the cylinders 7, 8, they are deflected alternately from left (FIG. 1) towards right (FIG. 2) with respect to the center line CL of the system. In accordance with the invention, the lateral shift of the position of the cylinders is so synchronized with the rotation of the cylinders that the web 2 is cut into a sheet or cut element 14 at the time the leading end of the web which will form the cut element 14 has already been introduced into a respective transport path. As the cylinders then shift, the sheets are deflected towards the other transport path.

Preferably, one or more deflection tongues 15 are located in advance of the transport paths in order to ensure reliable introduction of the leading element of the web, which will form the cut sheet 14 into the respective transport path.

The left transport path includes belts 16, 17, guided over respective transport rollers 18, 19, 20. The right transport path includes belts 21, 25 which are guided over respective transport rollers 22, 23, 24.

Figure 2:
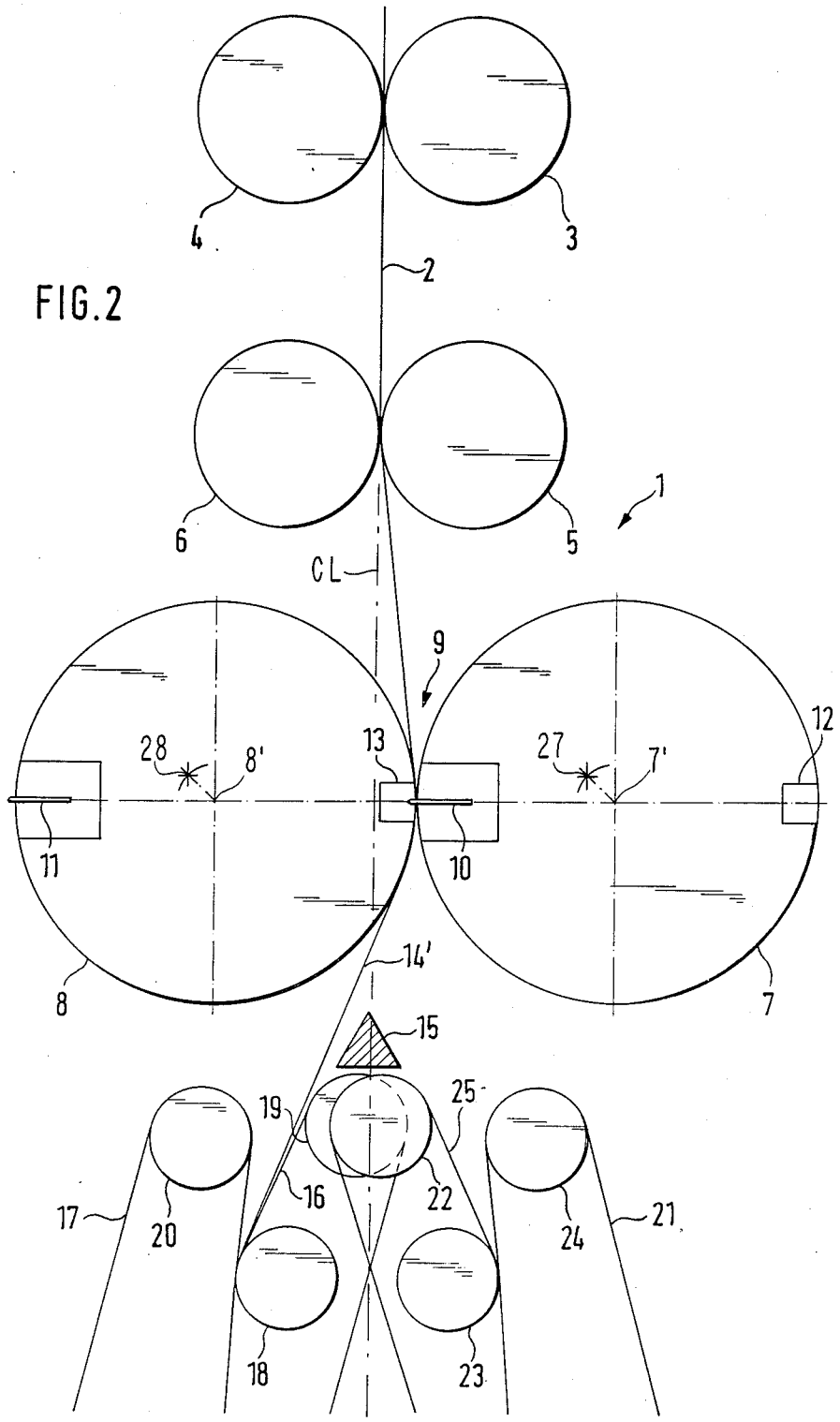

Operation: FIG. 1 shows the leading part of a sheet 14 already in the right transport path, formed by the belts 21, 25 on eccentric circles. Due to the eccentric position of the centers of rotation 7', 8' of the cylinders 7, 8, however, and upon cutting off of the sheet 14, the leading edge of the web 2 upwardly of the cut by cutters 11, 12 is pushed towards the left above the tongue 15. The leading edge of the web 2 upon rotation of the cylinders 7, 8 will be fed to the left transport path formed by the belts 16, 17 and to the left of tongue 15. This is the instant shown in FIG. 1, in which the sheet 14 is cut between the knife 11 and the counter cutter strip 12 on the cylinder 7. As the cylinders 7, 8 continue to rotate, the leading edge of the web 2 is fed downwardly, and will be directed to the left side of the tongue 15 and into the left transport path formed by the belts 16, 17. As the leading edge of the sheet is gripped by the transport belts 16, 17, the cylinders 7, 8 of course continue to rotate and will then shift towards the right, in anticipation of feeding the next leading edge of the web 2, after cutting off of the element 14' (FIG. 2) in the left transport path. FIG. 2 illustrates the position in which the cutting knife 10 and counter strip 13 are now roughly in alignment with the right transport path formed by belts 21, 25. At the instant of time shown in FIG. 2, the previously introduced portion of the web 2 is cut to form the cut sheet 14' which is already held with its leading end in alignment with the left transport path 16, 17. Upon continued rotation of the cylinders 7, 8, the cycle will repeat and the cylinders will shift to the position shown in FIG. 1, and so on. The eccentricity of cylinders 7 and 8 is shown schematically by the radius between the centers 7', 8' thereof and the eccentric centers 27, 28, respectively.

Eccentric positioning of the cutter cylinder pairs 7, 8 permits simultaneously cutting of the web into sheets to form the cut sheets 14, 14' and directing the respective cut sheets into selected transport paths. This change occurs rhythmically as the web 2 is deflected from one entrance area of a path to the other entrance area of the path. By synchronized cutting of the web 2 to form the sheets 14, 14', distribution of the respective sheets 14, 14' into one or the other of the transport paths 16, 17, or 21, 25, respectively, is automatically obtained. Journalling cylinders in eccentric bushings is well known in the printing machinery field; synchronizing the rotary movement of the cylinders with movement of the eccentric bushings, to oscillate the cylinders back and forth with respect to the center line CL can be done by any well known arrangements to synchronize rotary machine elements.

I claim:

1. Method of severing a moving continuous substrate web (2) into cut sheets (14, 14') and directing the cut sheets into different transport paths (16, 17; 21, 25) comprising (a) directing a leading edge of the paper web towards a selected removal transport path (e.g. 16, 17) for gripping the leading edge of the paper web in said selected transport path;

(b) gripping the leading edge of the paper web in said selected removal transport path;

(c) then severing the paper web after the leading edge has been directed into the selected path and gripped in said selected removal transport path; and (d) re-directing the cut edge towards the other transport path (21, 25);

(e) gripping the cut edge of the web by the other transport path (21, 25) and then cutting the web; then, (f) directing the thus cut edge of the web to the first selected transport path; and then (g) cyclically repeating steps (b)–(g).

2. The method of claim 1, wherein said step of directing the leading edge of the paper web or the cut edge of the paper web, respectively, comprises aligning, at least approximately, a nip between a pair of rollers with the respective removal transport path.

3. The method of claim 2, wherein said step of aligning a nip of the rollers with a respective removal transport path comprises shifting the centers of rotation of the rollers.

4. The method of claim 3, wherein said step of shifting the centers of rotation comprises moving the centers of rotation (7', 8') of said cylinders (7, 8) in a circular path which is eccentric with respect to the centers of rotation (7', 8') of said cylinders.

5. The method of claim 2, wherein the step of aligning the cut edge, respectively, of said web with the respective removal transport path comprises deflecting the paper web from a position essentially centered between said removal transport paths.

6. Combination cutting and path switching apparatus for web substrates, such as continuous printed paper webs, having means (3–6) for supplying the web (2) to the apparatus, said apparatus having a pair of engaged cylinders (7, 8) forming, respectively, a cutter cylinder and counter cylinder pair and defining a nip between said cylinders;

wherein the cylinders (7, 8) of the pair are journalled for rotation with respect to paper feed by the paper supply means;

means (38) are provided for movably supporting the centers of rotation (7', 8') of said cylinders (7, 8), to oscillate between positions in which the nip between the cylinders shifts laterally; and two removal transport path (16, 17; 21, 25) are provided, located symmetrically with respect to extreme lateral positions of the centers of rotation (7', 8') of said cylinders (7, 8) of the pair, said cylinders, upon said lateral shift of the nip, directing a leading portion of the paper web into a respective removal transport path before the web is cut by the cutter cylinder-counter cylinder pair; and wherein the rotary position of said cylinders (7, 8) and the eccentric position of said cylinders with respect to the transport paths, as well as the feeding speed of said supply means of the web are so synchronized with each other that the web is severed by the cutter cylinder-counter cylinder pair (7, 8) after the leading edge of the web has been gripped in one removal transport path (e.g. 21, 25), and while the cutter cylinder-counter cylinder pair is shifting its position to a location in at least approximate alignment with the other removal transport path (16, 17) for directing the leading edge of the web into said other removal transport path.

7. The apparatus of claim 6, including a deflection tongue (15) located in advance, with respect to the removal transport position of the paper web, of the removal transport paths (16, 17; 21, 25) for guiding the web substrate to a respective transport path in dependence on the instantaneous position of said cylinders (7, 8) with respect to one of the transport paths.

8. The apparatus of claim 6, wherein said removal transport paths (16, 17; 21, 25) include moving pairs of belts.

9. The apparatus of claim 6, wherein each of said cylinders includes a cutter knife (10, 11) and a counter element, in which the cutter knives and counter elements on the cylinders are located diametrically opposite each other, and said cylinders are oriented with respect to each other such that the cutter knife (e.g. 11) of one cylinder (8) faces the counter element (12) of the associated other cylinder for severing the web into respective sheets (14, 14') after the leading edge of the web has entered the respective transport path in accordance with the instantaneous position of the cylinders with respect to said transport paths.

10. The apparatus of claim 6, wherein the web supply means comprise a plurality of pulling rollers supplying the web (2) to the cutter cylinder-counter cylinder pair in approximately vertical direction.

11. The apparatus of claim 6, wherein said movable support means (37, 38) for the centers of rotation (7', 8') of the cylinders comprises eccentric means.

* * * * *